United States Patent [19]

Fadley

[11] Patent Number: 4,646,997

[45] Date of Patent: Mar. 3, 1987

[54] SUSPENDED SHEET-MATERIAL SUPPORT WEIGHT

[76] Inventor: Thomas C. Fadley, 4885 Refugee Rd., Columbus, Ohio 43232

[21] Appl. No.: 766,948

[22] Filed: Aug. 19, 1985

[51] Int. Cl.[4] ..... G09F 7/20

[52] U.S. Cl. ..... 248/201; 248/317; 248/327; 40/617

[58] Field of Search ..... 248/201, 61, 63, 317, 248/327, 324; 40/617, 607

[56] References Cited

U.S. PATENT DOCUMENTS

| | | | |
|---|---|---|---|
| 1,573,101 | 2/1926 | Steckol | 40/617 |
| 1,708,336 | 4/1929 | Stephenson | 40/617 |
| 2,304,743 | 12/1942 | Schott | 40/617 |
| 2,870,985 | 1/1959 | Martin et al. | 248/324 |
| 2,956,768 | 10/1960 | Livingston | 248/324 |
| 3,916,265 | 10/1975 | Friedman | 248/327 X |
| 4,089,129 | 5/1978 | Patterson, Jr. | 248/317 X |
| 4,520,984 | 6/1985 | Rouleau | 248/317 X |

*Primary Examiner*—Ramon S. Britts
*Assistant Examiner*—Karen J. Chotkowski
*Attorney, Agent, or Firm*—Philip J. Pollick

[57] ABSTRACT

A suspended sheet-material support weight 30 provides vertical support along the vertical height of the sign 40 preventing sign flexing and bending. The weight of the support and the rigid saddle-clamp attachment to a span cable 50 keep sign swing to a minimum. A clevis pin attachment 21 allows for rapid sign replacement and serves as a fail-safe device should the saddle-clamp bolts fail. The clevis pin and multiple sets of sign attachment holes in the support weights allow for level positioning of the sign when the span cable deviates from horizontal.

15 Claims, 3 Drawing Figures

SUSPENDED SHEET-MATERIAL SUPPORT WEIGHT

FIELD

This invention relates generally to support weights, and particularly to a support weight for suspended overhead sheet material.

BACKGROUND

The effect of wind on hanging overhead signs can produce conditions that are at best annoying and at their worst can cause severe injury to property and people and occasionally even death. An erraticly swinging sign can severely damage traffic signals, supporting poles, electric lines, and span cables. If conditions are severe enough, a wildly swinging sign can cut through electric cables causing them to fall to the ground below, can shear off supporting poles, and can itself break lose to become a flying guillotine. In any of these cases, the resulting pole tops, electrical cables, and the sign itself all can become lethal instruments of death and destruction.

In general, four approaches have been taken to solve this problem. In the first, the sign is permitted and even encouraged to swing freely in order to "spill" the wind (U.S. Pat. No. 4,520,984, Rouleau, R. J., June 4, 1985 and U.S. Pat. No. 4,089,129, Patterson, W. W., May 16, 1978). Although such free swinging brackets allow the sign to swing within limits and thus avoid many of the more serious problems, the freely swinging sign is likely to wear and eventually fail at the pivot points and is still an annoyance and distraction to the motorist who must attempt to read and follow its directives.

A second approach is to attach a second "tether" cable to the bottom of the sign. The use of such a second tether cable is illustrated in U.S. Pat. Nos. 3,916,265 and 3,989,217, Friedman, Jack J., Oct. 28, 1975 and Nov. 2, 1976, respectively, where it is used to stabilize a traffic signal rather than a sign. When a taut tether cable is attached to the bottom of a sign, there is a pronounced tendency for both the upper and lower cables to resonate with an up and down motion producing severe "loading" on the supporting poles to which the cables are attached. Such loading can loosen the pole from the ground or, more seriously, can cause high tension lines often attached to the pole to come in contact with each other or with other objects.

A third approach has been to attach weights to the bottom of the sign. When the support attachment at the top of the sign is rigid, severe winds cause flexing of the sign and eventual metal fatigue of the sign plate itself. Such flexing has been eliminated to some extent by the attachment of a modified light-weight flanged channel material along the vertical edges of the sign. If a free swinging device is used to attach the sign to an overhead support, the added bottom weight causes additional wear at the pivot points.

A fourth approach has been to drill large holes in the sign itself in order to allow the wind to pass through the sign. Although this greatly reduces the swinging motion of the sign, the "swiss cheese" appearance of these signs leaves much to be desired aesthetically.

SUMMARY OF THE INVENTION

A typical apparatus according to this invention overcomes these disadvantages by using a vertical elongate weight which affords considerable structural strength along the vertical length of suspended sheet material typical of that found in many overhead signs. The mass of the weight serves to reduce the swinging motions produced by the force of the wind while the attachment of the weight along the vertical length of the sign serves to greatly reduce sign metal fatigue brought about by shearing and bending forces when a sign is attached to a support only at its edge. By combining the weight with a rigid cable clamp, both the inertial mass of the weight and the torsional resistance of the cable combine to dampen considerably the erratic swinging motion of an overhead sign exposed to high winds. Because there are no pivot points that are subject to constant movement, there are essentially no parts that are likely to wear out or fail because of the severe frictional forces produced when free-swinging signs are exposed to high winds.

Although it is possible to use only a single support weight affixed along the vertical center of a sign, it is advantageous to use two or more such support weights in combination. Such a combination virtually eliminates any stress at the point where the support weight is attached to a clamp or other supporting device as a result of torsional twisting of the sign about the vertical axis of the weight.

The use of a saddle clamp with a horizontal clevis (pivot) pin through the legs of the clamp allows quick disconnection or replacement of a sign. Furthermore, the clevis pin acts as a safety device to hold the sign on the support (span) cable should the clamping bolts of the saddle clamp ever fail. Because the clevis pin allows the support weight to hang in a vertical position, this invention can be used with non-level supporting structures through the use of several sets of sign-attachment holes along the vertical length of each of two or more support weights. By selecting a particular set of holes which compensates for the difference in elevation of the support member at the points of support weight attachment, the sign can be maintained in a vertical position. When two or more support weights are used in combination and attached to the span wire with a clevis pin type saddle clamp, the finally assembly is essentially rigid with little lateral movement about the clevis pin in the plane of the span, an advantage that is not obtained when only one support weight is used.

DETAILED DESCRIPTION

Figure 1:
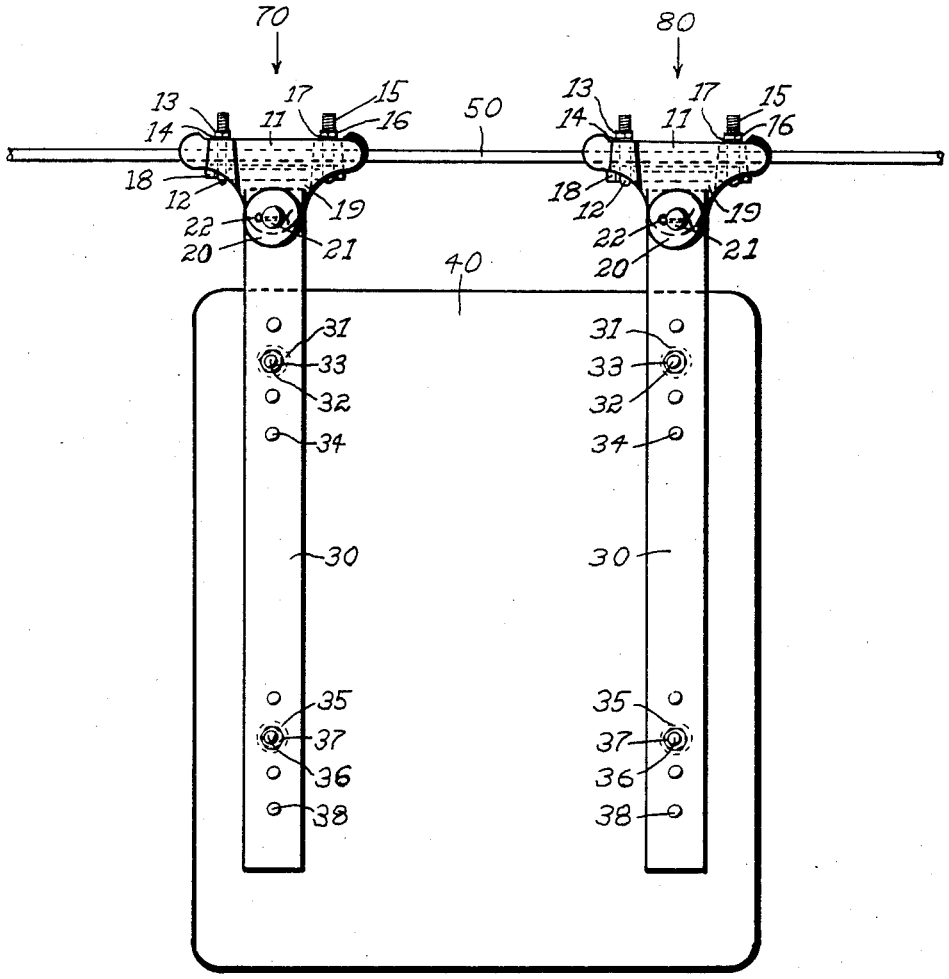
FIG. 1 is a front elevational view of the invention suspended from a span or transmission cable.

FIG. 1 illustrates the invention used in combination to obtain maximum wind resistance while at the same time reducing torsional strain on the clamp and support cable and lateral movement in the plane of the span cable found when only one support weight is used. The invention is illustrated with a supporting span cable 50 to which is attached the supporting weight by means of a saddle clamp comprising an inverted U-channel cable-engaging head portion 11 and a securing V-bar 18 which sandwiches the cable and is firmly clamped thereto by means of a pair of L-bolts 12 and 15 that grasp the V-bar 18 from below and on opposite sides and pass upward through the head portion 11 where they are firmly secured at the top with lock washers 14 and 17 and nuts 13 and 16, respectively.

The support weight 30 is placed between the two legs of the saddle clamp 19 and 23 and attached thereto by means of a clevis pin 21 passing horizontally through aligned holes in the two legs and upper part of the support weight 30 and perpendicular to the plane of the span cable 50. The clevis pin is held in place by means of a washer 20 and cotter pin 22.

Sheet material 40 is attached to the support weight 30 by means of two bolts 32 and 36 passing through horizontally aligned holes in flat washers 31 and 35, the sheet material, and the support weight and secured with elastic locknuts 33 and 37. The sheet material 40 is attached to the support weight 30 so that the support weight extends along most of the vertical length of the sign and thereby keeps the flexing of the sign to a minimum.

The support weight 30 is free to swing on the clevis pin 21 in the plane of the span cable 50. As a result, the support weights always hang freely in a vertical position and parallel to each other. As a result, differences in elevation of the span cable at the points of attachment of the two saddle clamps 70 and 80 can be compensated for by selecting the appropriate set of holes from multiple sets of holes in the support weights, e.g., 34 and 38 in support weight 70, and attaching the sign thereby.

Although this invention anticipates the use of a single support weight to suspend a sign, two or more support weights are preferred since such an arrangement minimizes the torsional stress against the legs of the saddle clamp and span cable produced by the rotation of a sign about the vertical axis of a single support weight. The use of two or more support weights also minimizes lateral movement about the clevis pin in the plane of the support cable. This invention anticipates the use of additional support weights as the width of the sign increases.

Figure 2:
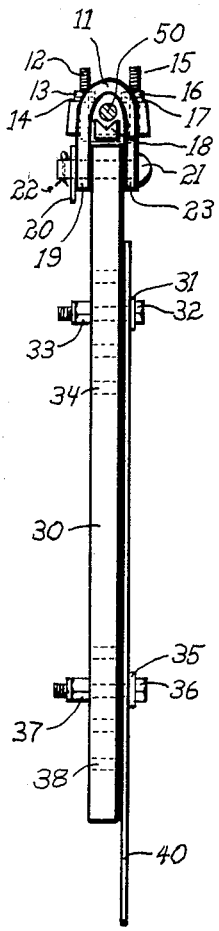
FIG. 2 is a side elevational view thereof.
Figure 3:
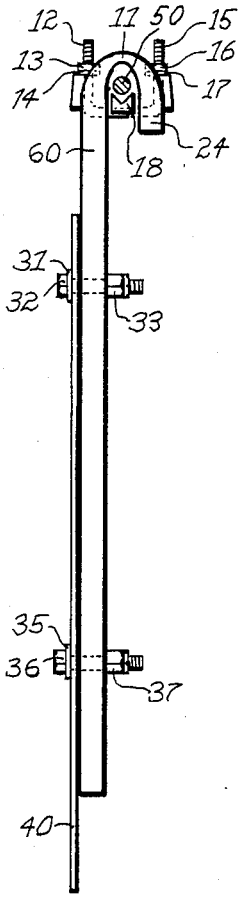
FIG. 3 is similar to FIG. 2, but shows an alternative embodiment.

FIG. 3 illustrates an alternative embodiment of this invention in which the saddle clamp head 11 and support weight 60 are formed as one piece. By extending clamp leg 24 in a downward direction and securing a bolt or pin through horizontally aligned holes in the downward extension and the opposite leg 60, said bolt or pin acts as a safety device retaining the hanger and sign on the span cable 50, should the saddle clamp L-bolts ever fail (not illustrated). Such a fail-safe feature is implicit in the clevis-pin arrangement shown in FIGS. 1 and 2.

This invention may also be used with non-cable supports such as, but not limited to, horizontal arms of pole, rod, or bar design. In such instances, other attaching means such as, but not limited to, U-bolt hangers, straps, and clamps are anticipated.

MATERIALS AND DIMENSIONS

Saddle clamps may be of either cast aluminum or steel and are commercially available. The span (support) cable typically is $\frac{5}{8}''$–$\frac{1}{2}''$ diam. Nuts, bolts, and washers are preferably of stainless steel. A $\frac{1}{2}'' \times 2''$ clevis pin is used in 17/32" diam. holes.

For a sign 30" wide and 36" high, two support weights should be used placed approximately 3" from each vertical edge and should support the height of the sign for at least 30". Each support weight is a $\frac{1}{2} \times 1\frac{1}{2} \times 34''$ steel bar, preferably galvanized (4 mil), and weighs approximately $7\frac{1}{4}$lbs. Bolts for attaching the sign to the support weight are $\frac{3}{8}'' \times 1''$ hex bolts with a flat washer and an elastic locknut.

While the forms of the invention herein disclosed constitute presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention.

I claim:

1. In combination, sheet material such as a sign or the like and a suspended, movement-damping, sheet-material support weight comprising a vertical, elongate, movement-damping support weight being of relatively high mass with respect to said sheet material, clamping means rigidly attached to one end of said weight for non-rotatable attachment to an overhead support, engaging means being attached along said weight for securing said sheet material along a substantial vertical length of said material so as to provide additional weight and structural support to said material said assembly of said weight and said engaging means providing means for preventing rotation of said combination of said sheet material and said support weight in a facing direction of said sheet material.

2. A support weight as defined in claim 1 wherein said clamping means is an inverted J-type clamp further comprising a cable-engaging clamp head and a cable securing means.

3. A support weight as defined in claim 2 wherein said clamp head and said support weight are formed as one piece.

4. A support weight as defined in claim 1 wherein said clamping means is a saddle clamp further comprising a cable-engaging clamp head and cable securing means.

5. A support weight as defined in claim 4 wherein said clamp head further comprises a pair of downwardly spaced legs each having a horizontally aligned hole, wherein said support weight comprises an upper and lower end with said upper end having a hole adapted so that said hole and said holes in said pair of downwardly spaced legs of said clamp head register in aligned relation so as to receive a pivot pin when said upper end of said support weight is placed between said legs.

6. A support weight as defined in claim 1 wherein said engaging means further comprises a plurality of holes in said sheet material along the vertical dimension thereof and a plurality of holes in said support weight along the length thereof adapted so that at least two said holes in said sheet material and two said holes in said support weight register in aligned relation to accept a fastening means.

7. In combination, sheet material such as a sign or the like and a suspended movement-damping, sheet-material support weights comprising a plurality of vertical, elongate, movement-damping support weights being of a relatively high mass with respect to said sheet material, clamping means rigidly attached to one end of each other said support weights for non-rotatable attachment to an overhead support, engaging means attached along each weight for securing said weight to said sheet material along substantial vertical lengths of said material so as to provide additional weight and structional support to said material, said assembly of said weights and said engaging means providing means for preventing rotation of said combination of said sheet material and said support weights in a facing direction of said sheet material.

8. A weighted sheet-material support system as defined in claim 7 wherein said overhead support is a span cable and said clamping means is a saddle clamp further comprising a cable-engaging clamp head and a cable fastening means.

9. A weighted sheet-material support system as defined in claim 8 wherein said clamp head further comprises a pair of downwardly spaced legs each having a horizontally aligned hole, wherein said support weight comprises an upper and lower end with said upper end having a hole adapted so that said hole and said holes in said pair of downwardly spaced legs of said clamp head register in aligned relation so as to receive a pivot pin when said upper end of said support weight is placed between said legs.

10. A weighted sheet-material support system as defined in claim 9 wherein said pivot pin is secured by a washer and cotter pin.

11. A weighted sheet-material support system as defined in claim 9 wherein said means engaging means further comprises a plurality of holes in said sheet material along a vertical dimension thereof and a plurality of holes in said support weight along a vertical length thereof adapted so that at least two said holes in said sheet material and two said holes in said support weight register in aligned relation to accept a fastening means.

12. A weighted sheet-material support system as defined in claim 11 wherein said plurality of holes comprises a plurality of sets of at least two holes so as to enable selection of one said set so as to position the sign in a level position when said support cable deviates from horizontal.

13. A weighted sheet-material support system as defined in claim 11 wherein said fastening means is a bolt, a washer, and a nut.

14. A weighted sheet-material support system as defined in claim 13 wherein said nut is a self-locking nut.

15. A weighted sheet-material support system as defined in claim 7 wherein said sheet material is a sheet-metal sign.

* * * * *